US006941715B2

(12) United States Patent
Potter

(10) Patent No.: US 6,941,715 B2
(45) Date of Patent: Sep. 13, 2005

(54) PREFABRICATED MODULAR BUILDING COMPONENT

(76) Inventor: John Potter, 6731 Orchard Ridge Trail, Woodbury, MN (US) 55125

( * ) Notice: Subject to any disclaimer, the term of this patent is extended or adjusted under 35 U.S.C. 154(b) by 0 days.

(21) Appl. No.: 09/825,202

(22) Filed: Apr. 3, 2001

(65) Prior Publication Data

US 2003/0074853 A1 Apr. 24, 2003

Related U.S. Application Data

(63) Continuation of application No. 09/608,816, filed on Jun. 30, 2000, now Pat. No. 6,804,923.
(60) Provisional application No. 60/142,273, filed on Jul. 2, 1999.

(51) Int. Cl.[7] ..... E04F 15/00; E04B 5/14
(52) U.S. Cl. ..... 52/480; 52/263; 52/403.1; 52/586.1; 52/747.1
(58) Field of Search ..... 52/263, 384, 309.17, 52/403.1, 480, 483.1, 512, 586.1, 586.2, 664, 762, 764, 772, 781.3, 747.1, 612

(56) References Cited

U.S. PATENT DOCUMENTS 3,082,489 A * 3/1963 Douglas ..... 52/309
3,456,411 A * 7/1969 Cacossa ..... 52/506.1
3,763,614 A * 10/1973 Hyde et al. ..... 52/309
3,875,719 A * 4/1975 Menge ..... 52/669
4,028,858 A * 6/1977 Rehbein ..... 52/384
4,044,520 A * 8/1977 Barrows ..... 52/309.12
4,059,936 A * 11/1977 Lukens ..... 52/764
4,170,859 A * 10/1979 Counihan ..... 52/779
4,443,988 A * 4/1984 Coutu, Sr. ..... 52/309.9
4,622,792 A * 11/1986 Betts ..... 52/263
4,628,645 A * 12/1986 Tafelski, Jr. ..... 52/169.1
4,674,245 A * 6/1987 Turner ..... 52/177
4,845,908 A * 7/1989 Stohs ..... 52/221
4,944,127 A * 7/1990 Clear ..... 52/309
4,945,697 A * 8/1990 Ott et al. ..... 52/403.1
5,361,554 A * 11/1994 Bryan ..... 52/480
5,367,853 A * 11/1994 Bryan ..... 52/702
5,412,915 A * 5/1995 Johnson ..... 52/177
5,465,546 A 11/1995 Buse
5,493,825 A * 2/1996 Gaston ..... 52/200
5,850,720 A * 12/1998 Willis ..... 52/650.3
5,930,965 A * 8/1999 Carver ..... 52/320
5,950,389 A * 9/1999 Porter ..... 52/586.1
6,233,896 B1 * 5/2001 Coup ..... 52/586.1
6,338,231 B1 * 1/2002 Enriquez ..... 52/602
6,453,632 B1 * 9/2002 Huang ..... 52/403.1
6,470,641 B1 * 10/2002 Faure ..... 52/480
6,558,766 B2 * 5/2003 Padmanabhan et al. ..... 428/54

FOREIGN PATENT DOCUMENTS

| | | | |
|---|---|---|---|
| DE | 8517514 | 8/1985 | |
| DE | 3726373 | 1/1989 | |
| EP | 0053092 | 10/1981 | |
| EP | 0321748 | 11/1988 | |
| EP | 0 485 297 A1 * | 5/1992 | ..... 52/177 |
| FR | 2349420 | 11/1977 | |

* cited by examiner

*Primary Examiner*—Winnie Yip
(74) *Attorney, Agent, or Firm*—Fulbright & Jaworski LLP

(57) ABSTRACT

A modular prefabricated deck system which includes a plurality of rectangular flooring modules. Each module may include a plurality of laminations, such as a decorative upper element, and a lower support element for supporting the module upon the underlying joist structure of the deck. Additionally, each module may include interlocking structure for engaging adjacent modules upon installation.

20 Claims, 10 Drawing Sheets

PREFABRICATED MODULAR BUILDING COMPONENT

RELATED APPLICATION

This application is a continuation of application Ser. No. 09/608,816 filed Jun. 30, 2000, now U.S. Pat. No. 6,804,923, which claims benefit of 60/142,273, filed Jul. 2, 1999, now abandoned.

TECHNICAL FIELD

This invention generally relates to a prefabricated modular building product finding particular utility in various building applications, including elevated deck structures, on-grade patio structures, and interior or exterior floor assemblies and wall assemblies.

BACKGROUND OF THE INVENTION

Known building elements and systems for patios, decks, and walls, and flooring have substantial limitations.

Exterior patios, decks and wood platform structures have become commonplace additions to houses and other residential and commercial structures. A value of such structures is derived from an enlargement of the usable living space for entertainment, as well as an enhancement in the quality of outdoor activities such as relaxation. As a result, outdoor structures have become increasingly popular in residential home construction. Residential homes, as well as a variety of other buildings, often incorporate exterior decks into their design. Additionally, decks are commonly added onto existing structures.

Deck structures typically include a support structure and a deck surface. One dominant method of deck construction includes: (1) a number of vertical post anchored to the ground; (2) horizontal beams supported above the ground by the vertical posts; (3) a number of horizontal joints, parallel to and uniformly spaced apart from one another and anchored to the beams; and (4) a floor surface of decking planks arranged horizontally and above and perpendicular to the joists. Deck construction typically utilizes common dimensional lumber and entails site construction of the deck of a size and configuration which is unique to a particular site. Limitations of the common lumber-based deck structures are well known. During construction, warped or misshapen lumber impedes quick application of the decking lumber to the support structure. Additionally, wood deck structures require periodic attention to maintain appearance and delay structural deterioration. For a variety of reasons, the availability of natural weather-resistant woods (redwood, cedar, teak, etc.) has become both limited and expensive. Chemically treated wood product may be utilized to delay natural fungal deterioration. Chemicals such as chromated copper arsenic (CCA) are used in the treatment process. Once incorporated into the deck structure, such chemically treated lumber may leach CCA or its derivatives into the surrounding environment. Maintenance of wood deck structures often includes periodic application of wood preservatives, stains, etc. In sum, known wood-based deck structures have substantial limitations.

Water entrapment between the deck surface and the support structure is often exacerbated by preventing or impeding the efficient run off of water, such as rain water. Deterioration of the wood deck structure often results from moisture trapped between the deck surface and the underlying support structure.

Also known are synthetic or synthetic/wood product combination lumber, such as TREX® brand polymer wood lumber manufactured by the TREX Corporation. Limitations of such lumber include the requisite slat-like aesthetic of the installed decking surface and the limited availability of color and texture combinations.

Modular deck systems are known. Typically, the modular systems include prefabricated wood panels for the deck flooring. Various types of prefabricated wood panels have been proposed. Usually the panels are constructed of individual boards secured together to form a modular panel. The prefabricated panel deck structures have included various approaches to securing the panels to an underlying support structure or sub-structure. One example is U.S. Pat. No. 4,622,792 to Betts, which discloses a wood-based modular deck structure comprising a plurality of rectangular flooring platforms and cooperating rectangular frames defined by intersecting joist members.

U.S. Pat. No. 5,361,554 to Bryan discloses a suspended deck system using prefabricated deck block modules as the deck surface. The block modules cooperate with a rectangular frame structure defined by intersecting joist members U.S. Pat. No. 4,028,858 to Rehbein discloses a suspended deck system using rectangular deck modules as the deck surface. The deck modules are interconnected with embedded pins to limit movement. A frame structure defined by parallel joist members supports the interconnected deck modules.

Known tile or stone flooring systems for interior use also have substantial limitations. Typical tile or stone installation requires a substantial floor underlayment for rigidly supporting the tile to minimize cracking or other damage. The floor underlayment may include a plurality of plywood sheet elements secured to the joists. Alternatively, the floor underlayment may include a reinforced concrete panel product, such as WONDERBOARD®, secured to the joist. Yet another approach to strengthening the floor underlayment may be a thick mortar bed having internal reinforcement. Each of these approaches to strengthening the floor for tile and stone installations includes limitations of increased costs and/or involved labor.

Furthermore, there exists a need for an on-grade patio product for economically and efficiently installing a patio structure. Known patio approaches include pavers, and larger modular concrete products which are set upon a compact base of sand and/or gravel. The pavers and other products are rigidly coupled together in an compressive sense (though not in a tensile sense) i.e., these products are capable of transferring a compressive force across the structure. As a result, these products often shift and/or settle after installation, leading to a discontinuous overall aesthetic. A need exists for an interlocking modular building product which facilitates efficient and economical installation of an on-grade patio structure.

Accordingly, it can be seen that a need exists for a modular building product and system of use which can be produced and applied in an ecologic and economic manner. It is to the provision of such a system that the present invention is primarily directed.

SUMMARY OF THE PRESENT INVENTION

The present invention provides a prefabricated modular building product having particular utility in a variety of building applications, including but not limited to elevated deck structures, interior and exterior floor assemblies, interior and exterior wall assemblies, and on-grade patio structures.

In one embodiment the present invention relates to a deck structure having improved deck surface aesthetic and durability. The deck structure according to one aspect of the present invention includes a plurality of prefabricated deck modules disposed upon an underlying support structure. The support structure may include a plurality of existing deck joists. The prefabricated deck modules may be manufactured from a variety of materials, such as concrete, natural stone, or polymer products. The deck modules may be disposed upon an existing deck joist structure during deck renovation or repair, or they may be utilized as a deck surface of a new deck. The deck modules are retained upon the deck structure by a plurality of panel support elements and spline elements. The panel support elements and spline elements laterally restrain the deck modules from movement and provide an improved deck system in which the edges of the deck modules are uniformly spaced from the edges of adjacent deck modules. Desirably, a relatively seamless deck surface aesthetic may thus be achieved. The panel support elements may include a pair of flanges for securing to the joists. The spline elements are adapted to be received into interior portions of adjacent deck modules.

It is an object of the present invention to provide a modular deck flooring system which is easy to install, and which possesses numerous advantages over the prior art deck floors. A decrease in maintenance and a more aesthetically appealing deck surface is thus provided.

In accordance with the invention, a deck system includes a plurality of individual prefabricated deck modules which are retained by a module support structure. The modules may be manufactured through a variety of approaches, materials, techniques, etc. Importantly, the modules include at least two structurally different elements, a first upper (deck) surface comprised of a low tensile strength material, such as natural stone or a concrete product, or tile, and a second lower surface comprised of a high tensile strength material. The first upper surface is coupled to the second lower surface through known materials securement means, including but not limited to adhesives and mechanical fasteners.

In one preferred form, the modules may be a cast concrete product, a synthetic polymer product, a natural stone product, or a combination thereof. In another preferred form, the modules include a lower composite material support layer, such as a plywood element or a high-strength composite element, and an upper natural stone facing layer. A lower element may be comprised of a high-strength composite material, such as glass-reinforced pultruded material. Alternative high-strength composite materials may be appreciated by those skilled in the present arts and the scope of the present invention is intended to cover such alternatives. One preferred approach to securing the upper layer to the lower layer includes an adhesive product. The module support structure may include a plurality of panel support elements and a plurality of module-engaging spline elements.

Another aspect of certain modules according to the present invention includes an optional ribbing structure, including a plurality of ribbing on the reverse side of a high-strength lower layer. Such ribbing may be incorporated in the design of the lower layer, such as during an extrusion or pultrusion process. As appreciated by those skilled in the relevant arts, the use of ribbing reduces panel cost and weight, while maintaining overall structural integrity of the product. The rib structure also beneficially facilitates rain water run-off, as water is permitted to pass between the module ribs and exit away from the joists. As a result, water deterioration of the deck structure can be minimized in comparison to known decking structures. An additional aspect of the present invention includes the provision of a gutter structure which cooperates with the drainage feature of the rib structure to receive and redirect rain water away from the deck underside.

In another embodiment, the present invention provides an exterior or interior flooring system which is easy to install, and which possesses numerous advantages over prior floor technologies. The use of modular prefabricated building panels according to the present invention facilitates time and structural efficiency over the known floor systems.

In yet another embodiment, the present invention provides an on-grade patio structure which is easy to install, and which possesses numerous advantages over known patio structures.

It is yet another object of the present invention to provide a modular wall structure which is easy to install, and which possesses numerous advantages over known wall structure systems.

These and other objects, features and advantages of the present invention will become apparent to one skilled in the art upon analysis of the following detailed description in view of the drawings.

BRIEF DESCRIPTION OF THE DRAWINGS

Yet other objects and advantages of the present invention may be seen from the followed detailed description taken in conjunction with the accompanying drawings wherein like numerals depict like parts throughout, and wherein.

DESCRIPTION OF PREFERRED EMBODIMENTS OF THE INVENTION

Figure 1:
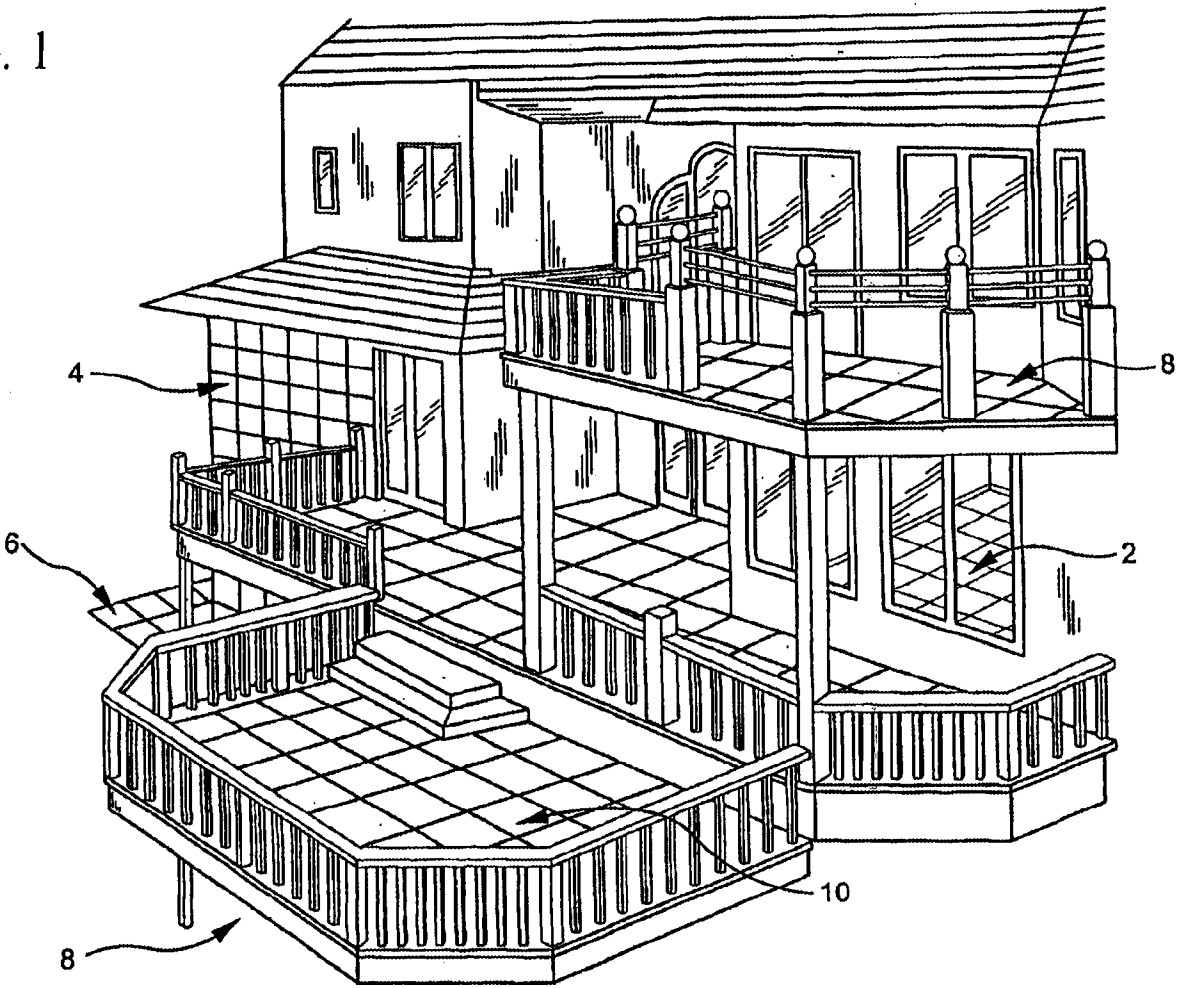
FIG. 1 illustrates is a perspective view of a deck structure according to the present invention.
Figure 2:
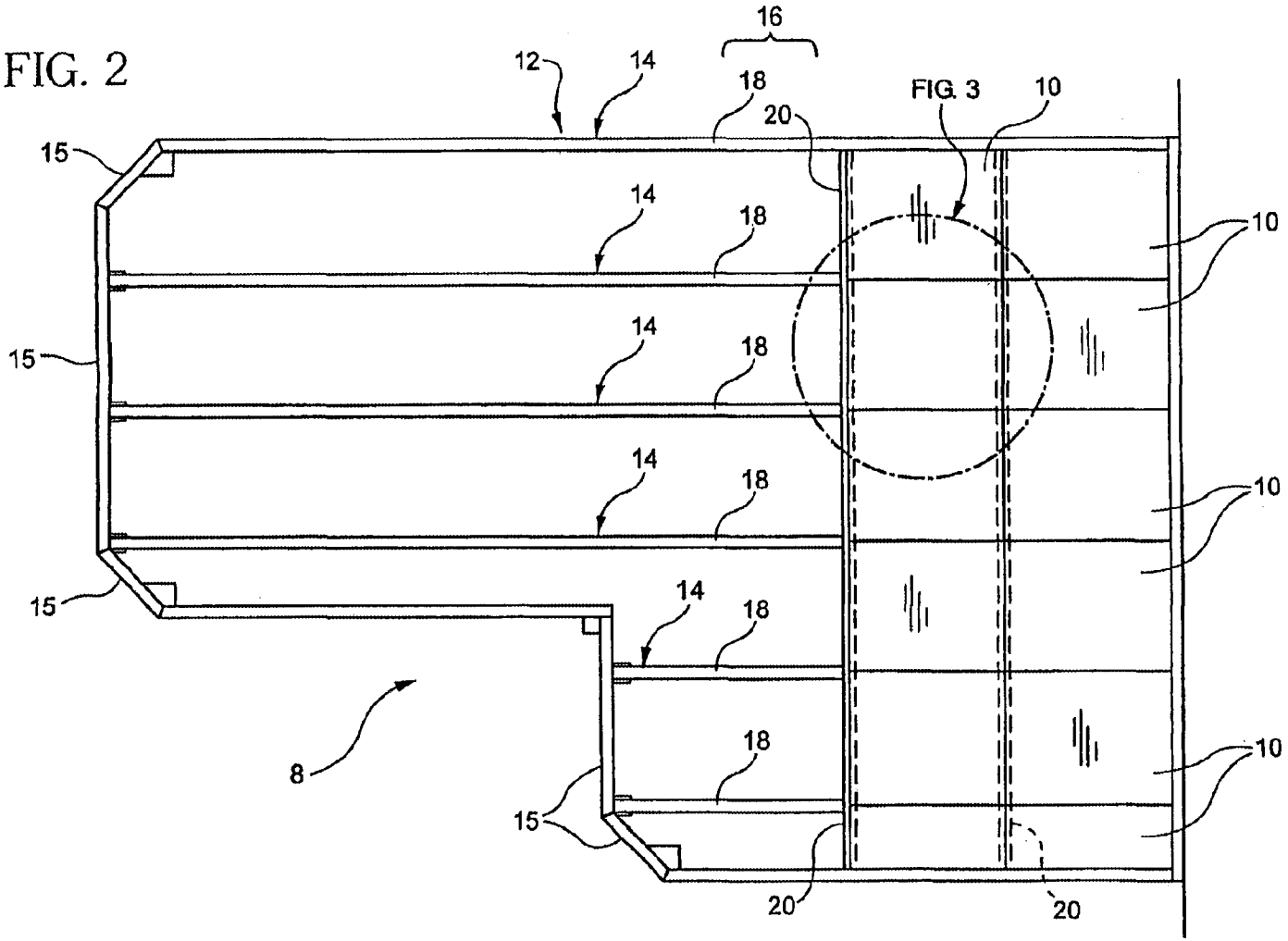
FIG. 2 is a top plan view of a portion of the deck structure of FIG. 1.

FIG. 1 illustrates a house utilizing preferred embodiment of the present invention, including an interior floor structure 2, a wall structure 4, and an on-grade patio structure 6, and a deck structure 8. Each of these structures utilizes a modular building panel 10 as further described herein. In one preferred embodiment, the modular building panels 10 may be utilized within a deck structure 8. Referring to FIG. 2, a deck structure 8 includes a plurality of modular building panels 10 disposed upon a deck substructure 12, including a plurality of joists 14 and associated framing elements 15.

The deck substructure 12 can be a new or existing structure. Additional uses for the modular panels 10 include application in a substantially vertical orientation as a wall component, placement in an interior of a house or other structure to form an interior floor structure, (See, also FIG. 8), and placement on-grade, for instance as a patio structure (See, also FIG. 11). A description of each of these envisioned applications of the building product 10 according to present invention is provided herein. Additional uses and applications which may be appreciated by those skilled in the relevant arts are intended to be within the scope of the appended claims of the invention.

Figure 9:
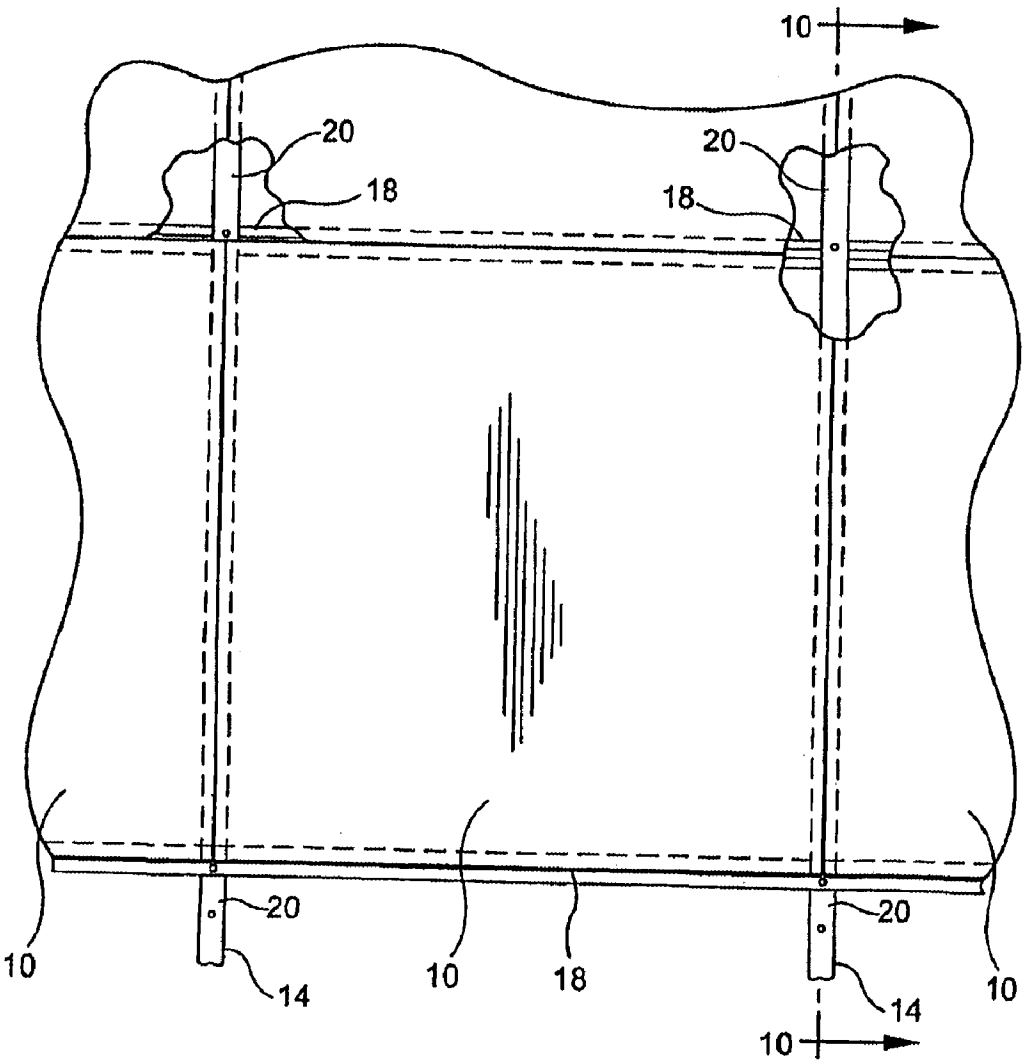
FIG. 9 is a top plan view of a portion of a deck structure according to another preferred embodiment of the present invention.
Figure 10:
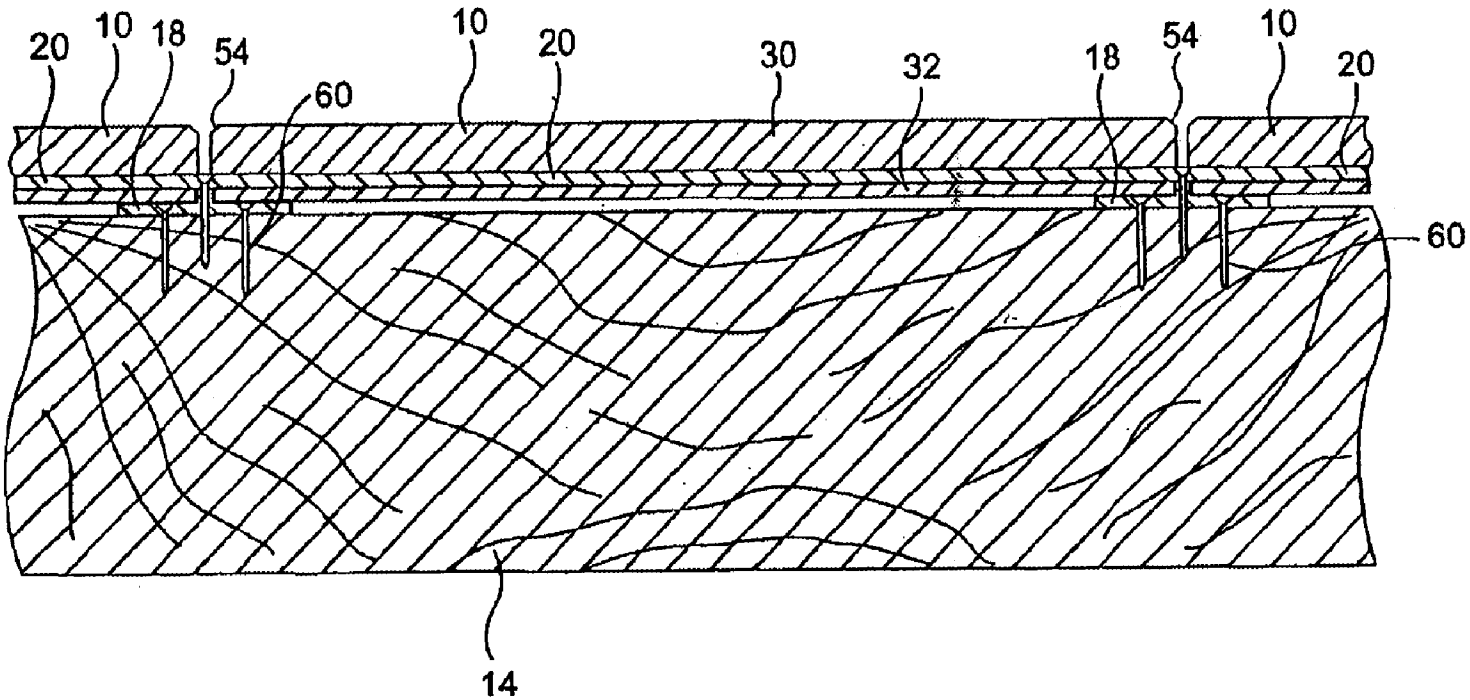
FIG. 10 is a cross sectional view of the deck structure of FIG. 9, taken along lines 10—10.

Referring still to FIG. 2, one application of the present invention is in an elevated deck structure 8. One embodiment of a deck structure 8 is illustrated wherein the deck panels 10 are disposed upon a plurality of joists 14 through a deck panel retaining structure 16. The deck panel retaining structure 16 includes a plurality of panel support elements 18 and a plurality of spline elements 20. Together the panel support elements 18 and the plurality of spline element 20 cooperate to secure the modular building panels to the deck structure 8, e.g., the joists 14. The panel support elements 18 and plurality of spline elements 20 are placed in substantially orthogonal relationship during assembly of the structure 8. In FIG. 2, the panel support elements 18 are aligned with the joists 14 of the deck. In comparison, FIGS. 9 and 10 illustrate another application wherein the panel support elements 18 are perpendicularly aligned relative to the joists 14 to span between adjacent joists 14 of the deck 8 and the spline support elements 20 are aligned and secured along the top of the joists 14.

FIG. 2 illustrates a partially complete deck 8 wherein a portion of the deck surface has yet to be provided upon the joists 14. The deck panels 10 are preferably sized for placement on new or existing deck joist structure featuring regularly spaced joists 14. For common 16 inch-on-center deck joisting, a deck panel 10 according to the present invention is approximately 16 inches square. It is appreciated that alternative sized deck panels 10 may also be practicable. It should also be appreciated that alternative configurations (other than square or rectangular) may be also be practicable. For instance, diamond-shaped deck panels 10, etc., may be practicable. Additionally, while the panels 10 of FIG. 2 are preferably 16 inch square products, other sizes or group of sizes are envisioned. For instance, the modular building panels 10 may have different sizes and shapes, including but not limited to square or rectangular elements. In this regard, an ashlar pattern of panels 10 may be formed using differently sized square and rectangular shaped modular panels 10. Additionally, alternative module 10 support approaches may also be practicable, such as discussed hereinafter. The deck 8 may further include one or more transparent panels, such as LEXAN panels, which are sized to cooperate with the support structure 18, 20, and which permit light to penetrate into the underside of the deck structure 8. Additionally or alternatively, the clear transparent panels may provide for light transmission of a light source beneath the deck structure 8 so as to provide lighting of the deck 8.

Figure 3:
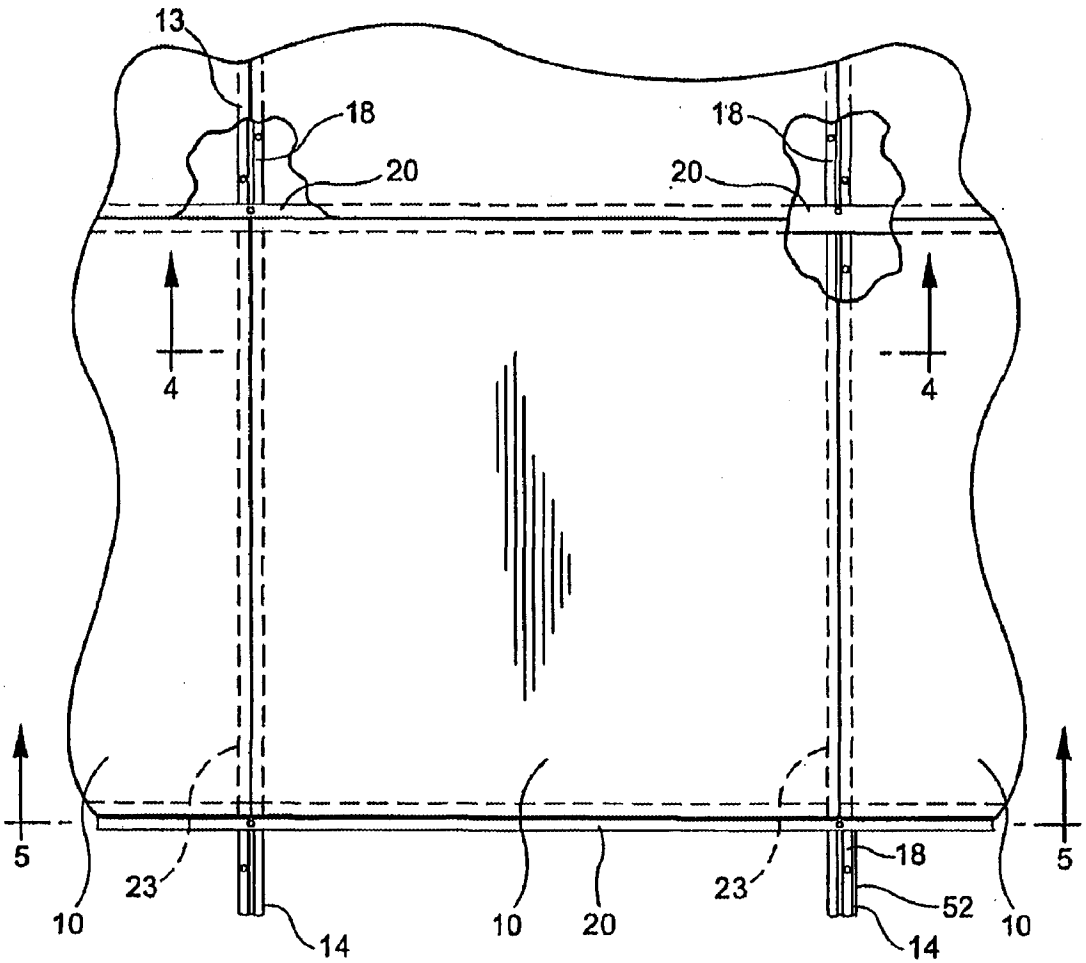
FIG. 3 is an enlarged portion of FIG. 2.

FIG. 3 is a detailed view of a portion of the deck structure of FIG. 2 illustrating the deck panels 10 disposed upon the joists 14. The deck panels 10 are secured to the joists 14 by the deck panel retaining structure 16, disclosed in this embodiment to include a panel support element 18 and a spline element 20, though alternative deck panel retaining structures and/or applications may be practicable. FIG. 3 also illustrates a panel support area 23 defined generally as the contact area between the deck panels 10 and the underlying joists 14. The panel support area 23 is substantially smaller than the overall panel 10 area so that a substantial portion of the panel 10 is in noncontacting relationship with the underlying deck structure.

Figure 4:
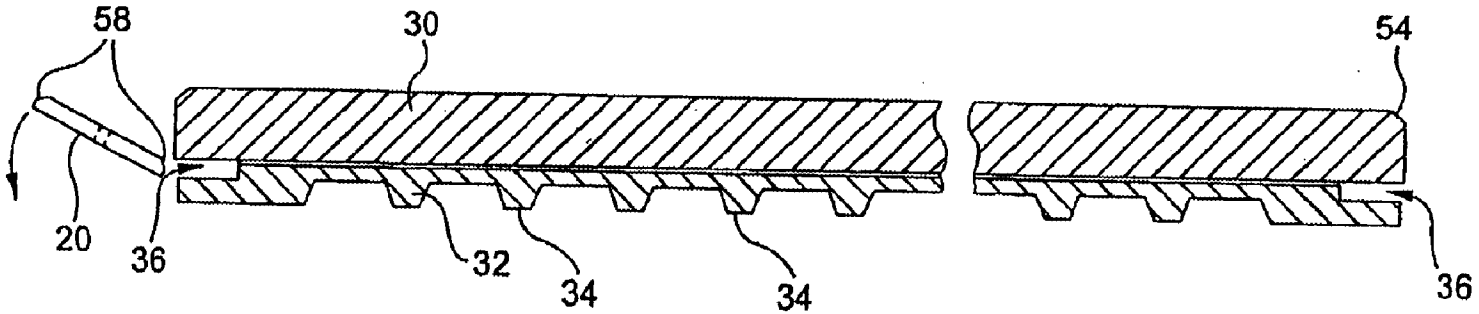
FIG. 4 is a cross sectional view of the deck structure of FIG. 3, taken along lines 4—4.
Figure 5:
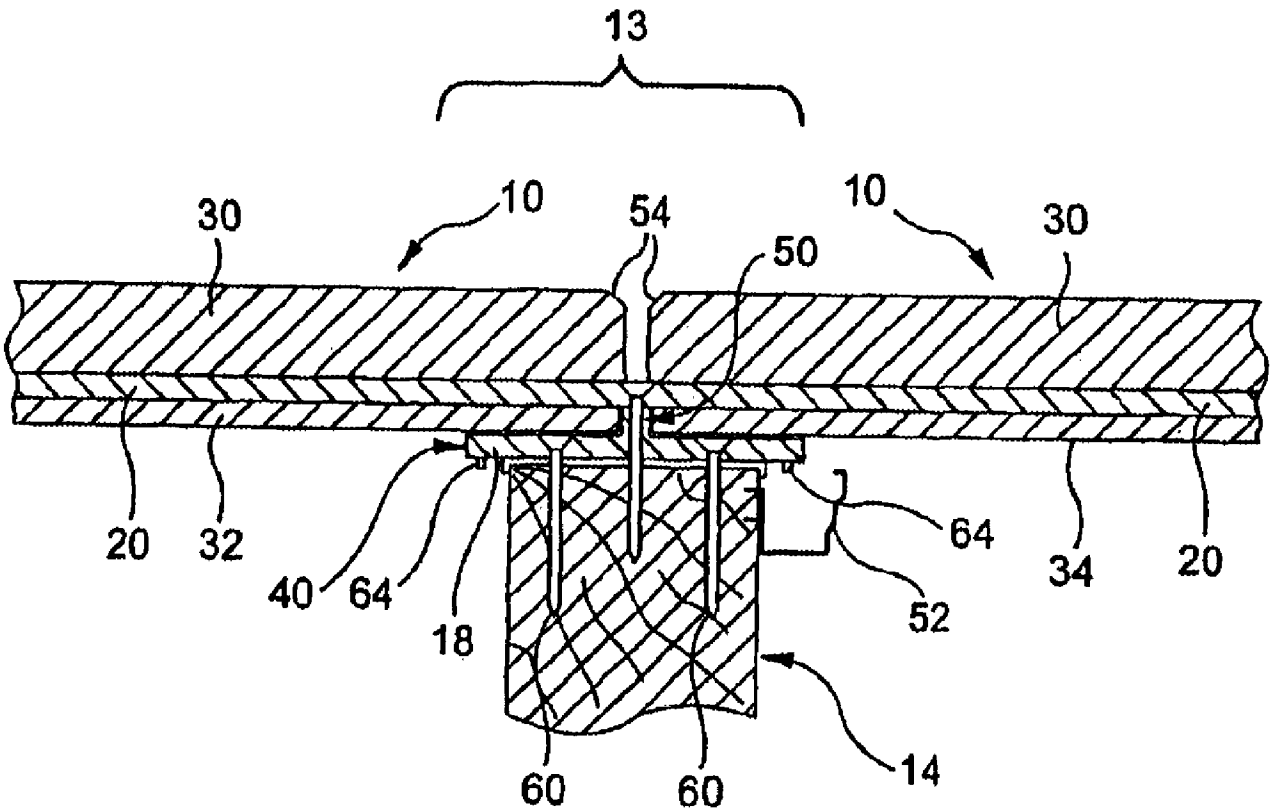
FIG. 5 is a cross sectional view of the deck structure of FIG. 3, taken along lines 5—5.

FIG. 4 is a cross sectional view of deck module 10 of FIG. 3, taken along section lines 4—4. FIG. 5 is a cross sectional view of the deck module 10, deck panel retaining structure 16, and underlying deck structure of FIG. 3, taken along section lines 5—5. The prefabricated deck panels 10 may be manufactured from a variety of known materials and processing techniques. For instance, the deck panel 10 may be a unitary cast concrete-based module 10 having an internal reinforcement, such as metal webbing or possibly polymer strips. In one preferred embodiment, the module 10 includes an upper stone element 30 disposed upon a pultruded fiber glass reinforced support structure 32. In other embodiments, the support structure 32 may be a high strength composite structure including a high-strength tensile strength element such as fiberglass, KEVLAR®, graphite, or carbon fibers. Alternative high-strength composite materials would also be appreciated by those skilled in the relevant arts. The upper element 30 is secured to the lower support structure 32, such as via an adhesive or other known securement approaches. Together, the upper element 30 and reinforcing lower support structure 32 provide a high strength, low weight stone or other natural or concrete-based modular deck panel 10.

In other embodiments, the upper layer 30 of the module panels 10 may be concrete product and decorated with known concrete finishing techniques to imitate a variety of natural stone products (for instance, BOMANITE® or other imprinted finishes, etc.). Alternatively, the upper layer 30 may be decorated with brick patterns (random, interlocking, ashlar, etc.). In yet another embodiment, the upper layer 30 may be decorated with indoor/outdoor carpet.

In the embodiments of FIGS. 4–5, the deck panel 10 includes a natural stone facing or veneer element 30 secured to an underlying support structure 32. The natural stone veneer 30 may be selected from among a group of architectural stone materials such as granite, sandstone, etc. The veneer element 30 includes a pair of beveled edges 54 to aid in visual alignment of the panels and reduce the tendency for chipping proximate the edges during handling and installation. The beveled edges 54 also improve the visual and structural aspects of panels 10 having veneer elements 30 of different thickness, e.g., the veneer elements 30 are aggressively textured material, such as some slates, etc. The upper layer 30 may be secured to the underlying support structure 32 with an adhesive, such as a two-part epoxy. Other adhesives or material joining techniques would also be appreciated by those skilled in the relevant arts. For example, mechanical fasteners may be used to couple the upper layer 30 to the lower support structure 32. One preferred securement approach is a two-part epoxy disposed as a layer between the elements 30, 32.

In one preferred embodiment, the underlying support structure 32 is a pultruded fiber glass reinforced element, though it may alternatively include a high-strength composite element, a plywood-based material, a concrete-based reinforced product, a metal alloy, or a polymer, fiberglass, or other composite material product providing suitable structural characteristics.

Referring particularly to FIGS. 4–5, the support structure 32 may be a pultruded fiberglass reinforced product having a substantially uniform cross section. The pultruded support structure 32 may include a plurality of ribs 34 for efficiently maintaining the structural strength of the support structure 32 while allowing material reduction as compared to a panel structure having a uniform cross sectional area. The ribs 34 provide an additional benefit by defining a plurality of channels for water run-off from the top surface. Water, such as rain water, may pass between the joint areas of the deck panel modules 10 and exit through the channels defined by the ribs 34. As illustrated in FIG. 5, the panel support element 18 may include a water break structure 64, such as a groove or small protrusion on the lower face of the element 18, which functions to direct the water away from the element 18. In additional embodiments of the present invention, a small gutter structure 52 may be disposed beneath the panels and be adapted to receive water run-off from between the ribs 34. In this regard, water, such as rain, which is received on the upper deck surface may be communicated away from the deck underside to provide a relatively dry deck undersurface. A sealant, such as silicone, may be used in conjunction with elements of the deck structure to provide a relatively water-tight structure, an hence a relatively dry area beneath the deck structure 8. For example, a silicon sealant may be applied between the deck modules 10, the deck structure 8, the panel support elements 18, and spline elements 20 to further direct water away from the deck underside.

In use, the ribs 34 of the support structure 32 are placed perpendicular to the joists 14 of the deck 8. As illustrated in FIGS. 4 and 5, the support structure 32 and upper layer 30 together define an interior region 36 on opposite ends of the deck module 10, wherein each of the interior regions 36 are sized to receive a portion of a spline element 20 during deck assembly as described herein.

Figure 6:
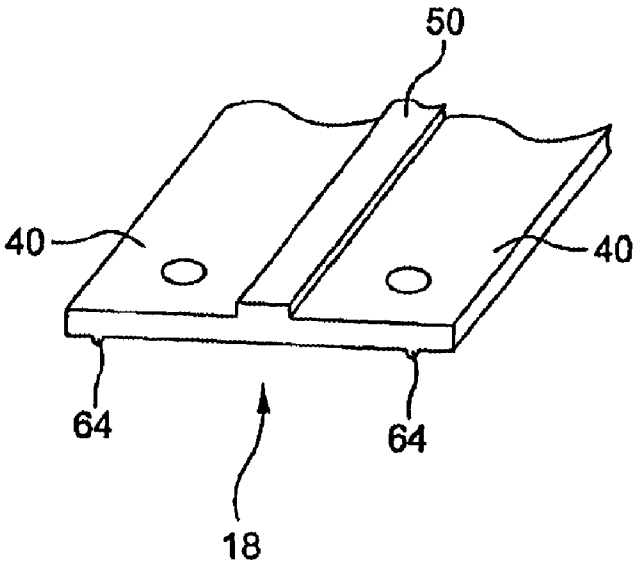
FIG. 6 is a perspective view of the panel support element of FIG. 1.

Referring to FIG. 6, a perspective view of a panel support element 18 is illustrated. In the embodiment of FIGS. 3 and 5, the panel support elements 18 function to support parallel edges of the deck modules 10 along top surface of the joists 14. In the embodiment of FIGS. 9 and 10, the panel support elements 28 function to support parallel edges of the deck modules 10 which are perpendicular to the top surface of the joists 14. The panel support elements 18 are elongated elements, and may be provided in standard lengths, such as 8 feet. The panel support elements 18 are approximately 2 inches in width and provide an overhang area at each side of the joist 14. The panel support element 18 is preferably wider than the joists 14 to account for twists or warps in the joists 14. The panel support elements 18 include a pair of flanges 40 for spacing and supporting adjacent deck modules 40. The panel support elements 18 further include a fastener-receiving structure 50 disposed intermediate the pair of flanges 40. The panel support elements 18 may be manufactured from a variety of materials, including but not limited to, pultruded fiber glass, composites, aluminum, or other alloys. It will be appreciated by those skilled in the relevant arts that alternative panel support element 18 configurations, sizes, designs, and implementations may also be practicable.

Figure 7:
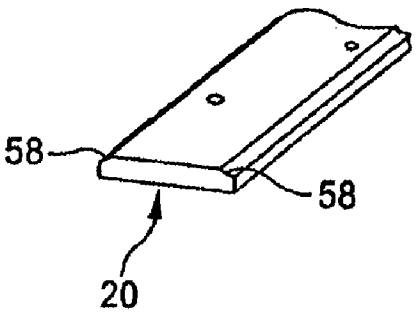
FIG. 7 is a perspective view of the spline element of FIG. 1.

Referring to FIG. 7, a perspective view of a spline element 20 is illustrated. The spline element 20 is retained into the interior regions 36 of adjacent deck modules 10. The spline elements 20 function to provide a uniform spacing between adjacent modular panels 10 as well as provide structural coupling between adjacent panels 10. The spline element 20 may be slightly larger than the interior regions 36 of the deck modules 10 so that a friction fit is provided between the spline element 20 and the deck module 10. The spline element 20 may be retained in the interior regions 36 of the deck modules 10 by friction fit or with an appropriate adhesive, such as construction adhesive. The spline element 20 includes a pair of beveled edges 58 to facilitate insertion into the interior regions 36 of the deck modules. Alternatively, the spline element 20 may be smaller than the interior regions 36 of the deck modules 10. The spline elements 20 are elongated elements, and may be provided in standard lengths, such as 8 feet. The spline element 20 of the preferred embodiment of the present invention span the entire transverse width of the deck structure. The spline elements 20 may be manufactured from a variety of materials, including but not limited to, pultruded fiber glass, composites, aluminum, or other alloys. It will be appreciated by those skilled in the relevant arts that alternative spline element 20 configurations, sizes, designs, and implementations may also be practicable.

Referring again to FIG. 5, a cross sectional view of a portion of the deck of FIG. 3 illustrates the relationship between the deck modules 10, and the deck module support structure 16. The deck module support structure 16 includes a panel support element 18 and a spline element 20. The panel support elements 18 are secured to the joists 14 by threaded fasteners 60, though alternative fastening approaches, such as staples, nails, adhesives, etc. may also be practicable. The spline elements 20, which run substantially perpendicular to the panel support elements 18 are also secured to the joists 14 by a threaded fasteners 60. The spline fastener 60 passes through the fastener receiving structure 50 of the panel support element 18 and secures the spline element 20 and the panel support element 18 to the joist 14.

A construction and application of the deck system according to one preferred embodiment of the present invention will be described. Once a joist 14 substructure has been provided, either as a new or existing construction, the elongated panel support elements 18 are secured to the top surfaces of joists 14 with threaded fasteners 60. A starter support element may be secured adjacent the house structure to engage the first row of modular panels 10. The starter support element may incorporate a variety of designs and configurations as appreciated by those skilled in the relevant arts. The panel support elements 18 may need to be shimmed and/or blocked to accommodate variations of the joist top surfaces. A variety of threaded fasteners 60 may be utilized to secure the panel support elements 18 to the joists 14. For example, the threaded fasteners may include stainless steel flat head screws which are countersunk into the panel support elements 18.

As a next step, the deck modules 10 are installed in a row, perpendicular to the joists 14. The deck modules 10 are placed upon the flanges 40 of adjacent parallel panel support elements 18. The ribbing 34 on the back side of the deck module 10 is aligned perpendicularly to the joists 14, and as a result the front edges of the deck modules 10 will reveal the spline receiving interior regions 36. Once the row of deck modules 10 has been placed, a spline element(s) 20 is placed into the interior regions 36 of the deck modules 10. As illustrated in FIG. 2, the spline element(s) 20 extended substantially entirely across the row of deck modules 10. Alternative approaches may include a plurality of shortened spline elements. The spline element(s) 20 is then secured by a threaded fastener 60 which passes through the fastener receiving structure 50 of the panel support element 18 and into the joist 14. Each row of the deck panels 10 is thus retained by the panel support elements 18 and the spline elements 20.

The next row of deck modules 10 is then placed against the previous row of deck modules 10. The spline receiving interior region 36 of the deck modules 10 is aligned to receive the secured spline 20 of the previously installed row. The next row is then secured to the joist 14 by another spline element(s) 20. Then process continues row-by-row until completion. As a result, and as illustrated in FIG. 2, each deck module 10 is supported on two opposite sides by the panel support elements 18. The two other opposite sides of the deck modules 10 are coupled to adjacent modules via the spline elements 20. Edge securement of the outer deck modules 10 may include threaded fasteners, or other known securement approaches. Additional edge treatment concepts may also be utilized to improve the overall deck aesthetic.

FIG. 1 also illustrates another embodiment of a modules 10. In another preferred embodiment, the modules 10 are provided in a vertical orientation to form a wall or wall covering. The wall modules 10 are supported in the vertical orientation by vertical support structures including a plurality of stud supporting elements and spline elements. The stud supporting elements may be similar to the panel supporting elements 18, 20 of the deck system and secured to the outer surfaces of the wall studs. The wall modules 10 may then be installed by placing a row of modules within the stud supporting elements and securing the row by the spline element(s). A next row of wall modules would then be provided across the top surface of the wall modules, and similarly secured to the underlying studs.

Figure 8:
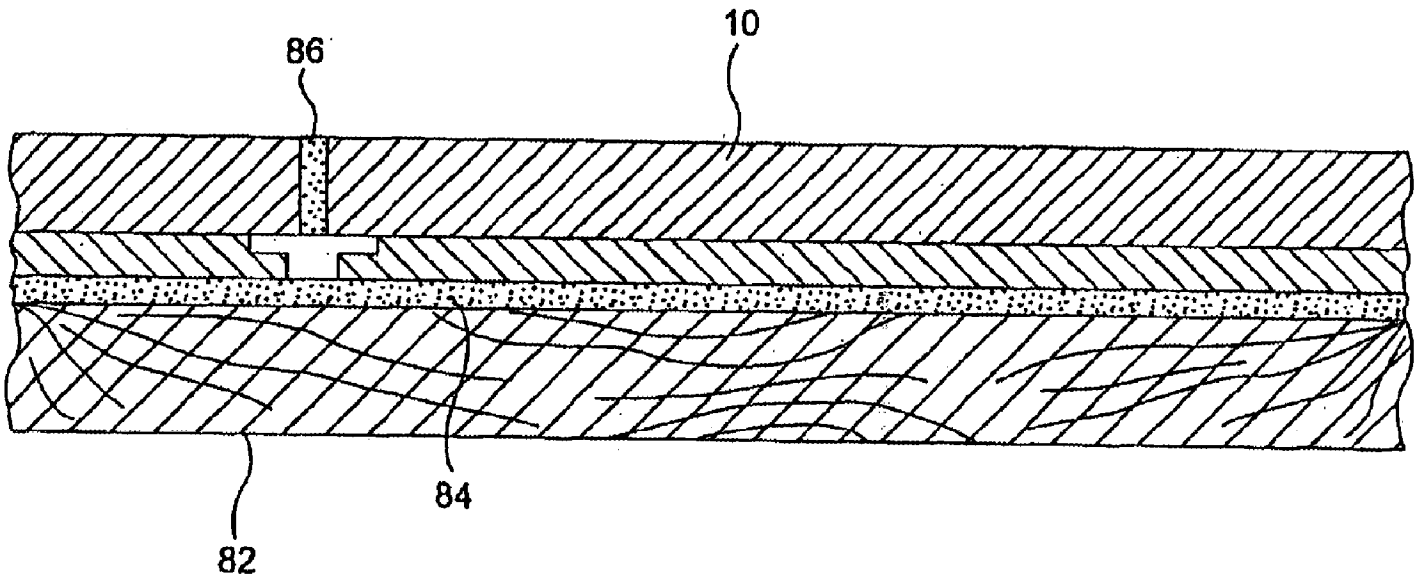
FIG. 8 is a side elevational view of a second preferred embodiment of the present invention.

FIG. 8 illustrates yet another use for the modular building panels 10 according to the present invention to provide a floor surface. A stone floor surface may be provided by securing the modules 10 to a floor underlayment 82, such as by an adhesive or thin-set mortar 84. In comparison, ceramic or stone tiles are typically set upon a structural underlayment or thick mortar bed capable of providing sufficient structural rigidity to the floor. The structural underlayment or thick mortar bed being necessary to provide structural rigidity to resist floor deflection resulting in tile cracking or damage. Unlike ceramic or stone tile, the modular panels 10 are structural elements capable of supporting tensile loads and are of sufficient strength to provide structural rigidity to the floor. As a result, additional structural underlayment or a thick mortar bed is not required in applications of the floor modules 10 according to the present invention. A flexible grouting 86 may be dispensed between the adjacent floor modules.

Referring now to FIGS. 9 and 10, yet another embodiment of the modular building product 10 is provided. In this embodiment, the modules 10 are disposed upon a plurality of joists 14 through a deck panel retaining structure 16 which includes a plurality of panel support elements 18 and a plurality of spline elements 20. In comparison to the embodiments of FIGS. 1–8, panel support elements 18 are secured to the top surface of the joists 14 and the spline elements 20 span between adjacent joists 14. FIG. 10 is a detailed view of a portion of the deck structure of FIG. 9 illustrating the deck panels 10 disposed upon the joists 14. The deck panels 10 are secured to the joists 14 by the panel support element 18 and a spline element 20, though alternative deck panel retaining structures and/or applications may be practicable. The use of panel support elements 18 disposed upon the joists 14, as illustrated in FIGS. 9 and 10, permits the application of the present invention on decks or other structures that are framed with curves, unusual, or perpendicular framing elements.

Figure 11:
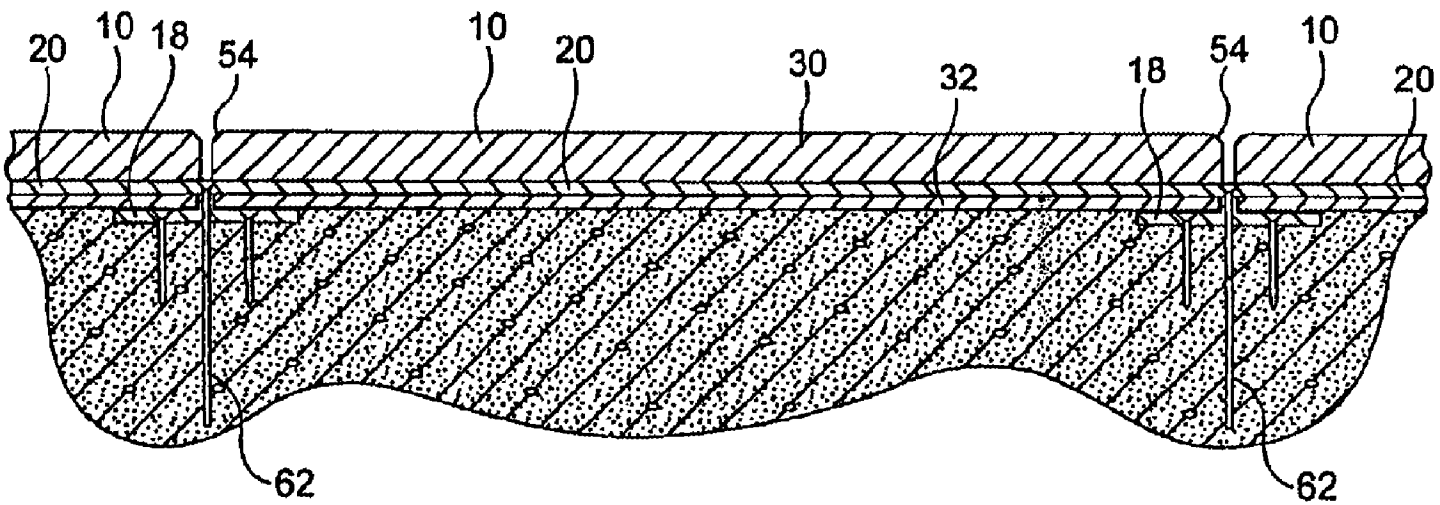
FIG. 11 is a cross sectional view of an on-grade patio structure according to the present invention.

Referring now to FIG. 11, yet another embodiment of the present invention provides an on-grade patio structure. The modules 10 are supported on grade, such as on a layer of sand above a layer of compacted granular fill. The modules 10 are coupled together and to the earth through patio panel retaining structure which may include a plurality of patio panel support elements 18 and a plurality of spline elements 20, such as disclosed in FIGS. 6 and 7. The patio deck panels 10 are secured to the earth by elongated elements 62, such as long spikes or nails, which pass through and engage the panel support elements 18 and a spline elements 20. Alternative patio deck panel retaining structures and/or applications may be practicable. The modular panels 10 according to the present invention may be utilized for on-grade patio structures and other structures, such as a stand alone outdoor structure.

It is understood that even though numerous characteristics and advantages of the present invention have been disclosed in the foregoing description, the disclosure is illustrative only and changes may be made in detail. Other modifications and alterations are within the knowledge of those skilled in the art and are to be included within the scope of the appended claims.

I claim:

1. A deck structure comprising:

an underlying deck structure including a plurality of joists;

a plurality of modular building panels, each of said plurality of building panels including a first element being relatively inflexible and of a material selected from among the group consisting of: stone, mineral, tile, and concrete product, and further including a second element of a fiber-reinforced composite material, said second element being disposed beneath the first element and coupled thereto, said second element supporting the building panel upon two of the plurality of joists, each of said building panels further including at least one groove; and a spline engaging a pair of grooves of an adjacent pair of building panels, said spline being secured by threaded fasteners passing through the spline and into at least two of the plurality of joists, and said spline having a length substantially greater than a distance between an adjacent pair of joists, whereby the spline spans across more than two joists of the deck structure.

2. A deck structure of claim 1 wherein the first element is adhesively secured to the second element.

3. A deck structure of claim 1 wherein the first element and the second element are each generally planar.

4. A deck structure of claim 3 wherein the fiber-reinforced composite material includes a material selected from the group consisting of: KEVLAR fiber, carbon fiber, and fiber glass.

5. A deck structure of claim 4 wherein the composite material further includes a material selected from the group consisting of: epoxies, resins, and adhesives.

6. A deck structure of claim 1 wherein the spline is aligned generally perpendicular to the joists.

7. A deck structure of claim 1 wherein the spline is aligned generally parallel to a joist.

8. A deck structure of claim 1 wherein the second element includes a rib structure.

9. A deck structure of claim 1 wherein the second element defines an interior region along at least a pair of edges.

10. A deck structure of claim 1 wherein the first element and second element are equivalent in size.

11. A deck structure of claim 1 wherein the first element and second element are generally square in shape.

12. A deck structure comprising:

a deck frame including a series of joists;

a plurality of modular panels arranged in a substantially abutting relationship, each panel being of a layered construction including a top element and a bottom element, said top element being of a material providing substantial compressive strength and limited tensile strength, said bottom element being of a fiber-reinforced material, each panel having a groove; and a spline engaging a pair of grooves of an adjacent pair of panels, said spline being secured to at least one of the joists by threaded fasteners to secure the pair of panels to the deck frame, and said spline having a length substantially greater than a distance between a pair of joists, whereby the spline element spans across more than two joists of the deck frame.

13. A deck structure according to claim 12 wherein the spline is aligned generally parallel to a joist.

14. A deck structure according to claim 12 wherein the spline is aligned generally perpendicular to a joist.

15. A deck structure according to claim 12 wherein each panel includes a plurality of grooves.

16. A deck structure according to claim 15 wherein each panel is engaged by a pair of splines.

17. A method of building a deck structure comprising the steps of:

providing a deck frame including a series of joists;

providing a plurality of modular panels, each panel being of a layered construction including a top element and a bottom element, said top element being of a material providing substantial compressive strength and limited tensile strength, said bottom element being of a fiber-reinforced material, each panel having at least one groove;

providing an elongated spline element having a length substantially greater than a distance between an adjacent pair of joists, whereby the spline element spans across more than two joists of the deck frame;

placing a row of panels across the series of joists of the deck frame;

inserting the spline element into a groove of each panel of the row of panels; and securing the spline element to the series of joists to connect each panel to the deck frame.

18. A method of building a deck structure of claim 17 further comprising the steps of:

providing a second spline element;

inserting the second spline element into another groove of the panel;

securing the second spline element to one or more joists.

19. A method of building a deck structure comprising the steps of:

providing a deck frame including a series of joists;

providing a plurality of modular panels, each panel being of layered construction including a top element and a bottom element, said top element being of a material providing substantial compressive strength and limited tensile strength, said bottom element being of a fiber-reinforced material, each panel having at least one groove;

providing a plurality of panel support elements;

attaching the plurality of panel support elements to the series of joists;

providing a spline element;

placing a series of panels upon the plurality of panel support elements;

inserting the spline element into a groove of each of the panels; and securing the spline element to the series of joists to connect the plurality of panels to the deck frame.

20. An assembly for providing a deck surface for a deck structure having a plurality of generally parallel joists, said assembly comprising:

a plurality of modular building panels, each of said plurality of building panels including a first element being relatively inflexible and of a material selected from among the group consisting of: stone, mineral, tile, and concrete product, and further including a second element of a fiber-reinforced composite material, said second element being disposed beneath the first element and coupled thereto, said second element supporting the building panel upon two of the plurality of joists, each of said building panels further including at least one groove; and a spline engaging a pair of grooves of an adjacent pair of building panels, said spline being secured to the plurality of joists by threaded fasteners to secure the pair of building panels to the deck structure, and said spline having a length substantially greater than a distance between an adjacent pair of joists, whereby the spline spans across more than two joists of the deck structure.

* * * * *

UNITED STATES PATENT AND TRADEMARK OFFICE

CERTIFICATE OF CORRECTION

PATENT NO. : 6,941,715 B2
DATED : September 13, 2005
INVENTOR(S) : John Potter

It is certified that error appears in the above-identified patent and that said Letters Patent is hereby corrected as shown below:

Column 4,
Line 1, delete "3" and insert -- 1 --.

Signed and Sealed this

Thirty-first Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,941,715 B2
DATED : September 13, 2005
INVENTOR(S) : John Potter

It is certified that error appears in the above-identified patent and that said Letters Patent is hereby corrected as shown below:

Column 10,
Line 1, delete "3" and insert -- 1 --.

Signed and Sealed this

Sixth Day of June, 2006

JON W. DUDAS
*Director of the United States Patent and Trademark Office*